US009878197B2

(12) United States Patent
Mayes

(10) Patent No.: US 9,878,197 B2
(45) Date of Patent: Jan. 30, 2018

(54) EXERCISE DEVICE

(71) Applicant: Keiko Mayes, Fort Worth, TX (US)

(72) Inventor: Keiko Mayes, Fort Worth, TX (US)

( * ) Notice: Subject to any disclaimer, the term of this patent is extended or adjusted under 35 U.S.C. 154(b) by 0 days.

(21) Appl. No.: 15/462,108

(22) Filed: Mar. 17, 2017

(65) Prior Publication Data

US 2017/0266482 A1 Sep. 21, 2017

Related U.S. Application Data

(60) Provisional application No. 62/310,898, filed on Mar. 21, 2016.

(51) Int. Cl.
*A63B 21/00* (2006.01)
*A63B 21/02* (2006.01)

(52) U.S. Cl.
CPC ..... *A63B 21/4027* (2015.10); *A63B 21/023* (2013.01)

(58) Field of Classification Search
CPC ..... A63B 21/02; A63B 21/023–21/026; A63B 21/0407–21/05; A63B 69/34–69/345; A63H 3/04; A63H 3/46
USPC ..... 446/369, 370, 374, 379–380
See application file for complete search history.

(56) References Cited

U.S. PATENT DOCUMENTS 1,551,250 A * 8/1925 Henry ..... A63H 3/04 223/66
5,194,033 A * 3/1993 Wright ..... A63H 3/003 446/311
5,700,230 A * 12/1997 Cardona ..... A63B 69/34 482/83
6,063,011 A * 5/2000 Pelchat ..... A63B 69/004 482/83
9,498,693 B1 * 11/2016 Kraus ..... A63B 69/345

* cited by examiner

*Primary Examiner* — Loan H Thanh
*Assistant Examiner* — Jennifer M Deichl
(74) *Attorney, Agent, or Firm* — Dale J. Ream

(57) ABSTRACT

An exercise device for use by persons with limited strength or mobility includes a a frame member situated in an interior area of a body member. First and second upper appendages are coupled to and extend away from upper left right regions of the body member. First and second lower appendages are coupled to and extend away from lower left right regions of the body member. A top appendage may extend away from a top region of the body member. A tension member, such as a tension spring, is situated inside each appendage and is configured to be selectively bent, extended, or otherwise manipulated and is resilient to return to an unbent and retracted configuration. Movement of respective tension members enables a person to exercise, experience the touch sensation, and have feelings of pleasure and enjoyment. A magnet attached to the frame member attracts other magnetic or metal items.

13 Claims, 10 Drawing Sheets

EXERCISE DEVICE

REFERENCE TO RELATED APPLICATIONS

This non-provisional patent application claims the benefit of provisional application Ser. No. 62/310,898 filed on Mar. 21, 2016 titled Exercise Device for Children which is incorporated herein by reference in its entirety.

BACKGROUND OF THE INVENTION

This invention relates generally to exercise devices and, more particularly, to an exercise device having internal tension structures and external appendages to enable persons with decreased mobility, dexterity, or strength to obtain low-impact exercise and entertainment.

Some children are born with physical challenges that hinder them from engaging in normal exercise such as running, jumping, and playing of games intended to develop strength, motor skills, and provide general entertainment. Further, some adults develop medical conditions or injuries that likewise hamper their ability to workout at a gym or otherwise receive exercise and enjoyment. In either case, this lack of exercise may make it difficult to perform basic activities of daily living due to muscle atrophy—even basic activities like brushing one's hair or teeth or eating without assistance.

Therefore, it would be desirable to have an exercise device in a handheld form of a doll, stuffed animal, or toy having multiple internal springs that may be manipulated through the outer fabric layer of the device, such manipulation causing light impact exercise, stimulation, and enjoyment to the user. Further, it would be desirable to have an exercise device that is durable and may result in a user regaining mobility, strength, and improved movement of his muscles and limbs.

SUMMARY OF THE INVENTION

An exercise device for use by persons with limited mobility or dexterity according to the present invention includes a body portion defining an interior area and a frame member situated in the interior area and having a lower end that is wider than an upper end for stable positioning on a surface. First and second upper appendages are coupled to and extend away from upper left and upper right regions of the body member. Similarly, first and second lower appendages are coupled to and extend away from lower left and lower right regions of the body member. A top appendage may extend away from a top region of the body member. A tension member, such as a tension spring, is situated inside each appendage and is configured to be selectively bent, extended, or otherwise manipulated and is resilient to return to an unbent and retracted configuration. Movement of respective tension members enables a person to exercise, experience the touch sensation of the springs, and have feelings of pleasure and enjoyment.

Therefore, a general object of this invention is to provide an exercise device having multiple internal tension members that may be stretched, bent, and otherwise manipulated so as to provide exercise and enjoyment to a person having decreased strength and mobility.

Another object of this invention is to provide an exercise device in the form of a stuffed animal or toy to promote usage and efficacy.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An exercise device for use by persons having decreased strength, mobility, or dexterity according to a preferred embodiment of the present invention will now be described in detail with reference to FIGS. 1 to 9*b* of the accompanying drawings. The exercise device 10 includes a body portion 20, a frame member 34 situated inside the body portion 20, a plurality of tension members situated inside respective upper, lower, and top appendages that extend away from the body portion 20.

Figure 9A:
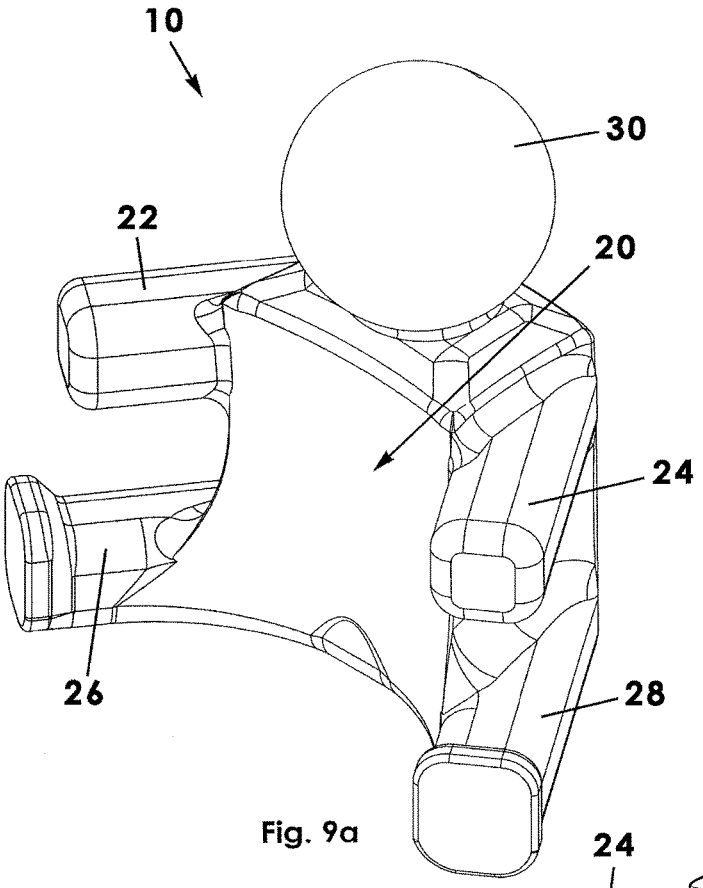
FIG. 9*a* is a perspective view of an exercise device according to another embodiment of the present invention.
Figure 9B:
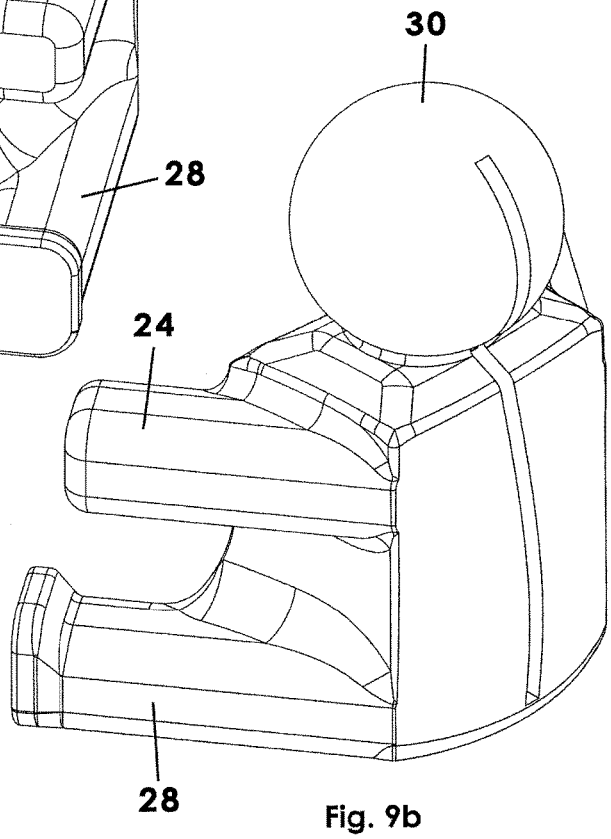
FIG. 9*b* is a reverse perspective view of the exercise device as in FIG. 9*a*.

The body portion 20 defines an interior area that is hollow and which may be substantially filled with a padding material, foam elements, or other stuffing. The body portion 20 may be constructed in the form of a stuffed animal or other familiar toy. In combination with the appendages, the body portion 20 may have a shape configuration indicative of a variety of animals including, but not limited to, a tiger, lion, dog, cat, elephant, bear, or the like. The body portion 20 and appendages may be constructed of a durable yet flexible material such as leather, faux leather, material that is easily disinfected, and material that includes print and design indicia. In an embodiment, the body portion 20 may be color coded to correspond with associated tensions of the tension members inside. In addition, the back of the body portion 20 may include an opening for easy accessibility to the interior area (FIGS. 9*a* and 9*b*).

A frame member 34 may be situated within the interior area of the body portion 20. The frame member 34 may be a plate having a generally flat or planar configuration except as specifically described below. The frame member 34 may include a main plate 36 having a trapezoidal configuration; in other words, the main plate 36 includes a lower end 38 (which may also be referred to as a lower edge) and an upper end 40 (which may also be referred to as an upper edge) opposed to the lower end 38, the lower end 38 having a width dimension that is greater (wider) than a width dimension of the upper end 40.

Further, the frame member 34 may include a pair of side plates 42 coupled to respective opposed side edges of the main plate 36. Each side plate 42 extends forwardly and outwardly at an angle away from a front surface of the main plate 36. Together, the geometry of the main plate 36 and side plates 42 of the frame member 34 situated inside the body portion 20 enable the exercise device 10 to sit upright upon a flat surface such as the floor, countertop, or bed surface.

A plurality of appendages may be coupled to the body portion 20 and extend away therefrom, each appendage being configured to imitate an arm, leg, or head of whatever animal or object is being simulated by the body portion 20. The body portion 20 may also include graphic design or other indicia to further enhance the appearance as an animal. Now, more particularly, a first upper appendage 22 defining a hollow interior space may be coupled to and extending away from an upper left region of the body portion 20. In other words, a proximal end of the first upper appendage 22 may be attached to the body portion 20 with a distal end being displaced from the body portion 20. Similarly, a second upper appendage 24 defining a hollow interior space may be coupled to and extending away from an upper right region of the body portion 20. In other words, a proximal end of the second upper appendage 24 may be attached to the body portion 20 with a distal end being displaced from the body portion 20.

In like manner, a first lower appendage 26 defining a hollow interior space may be coupled to and extending away from a lower left region of the body portion 20. In other words, a proximal end of the first lower appendage 26 may be attached to the body portion 20 with a distal end being displaced from the body portion 20. Similarly, a second lower appendage 28 defining a hollow interior space may be coupled to and extending away from a lower right region of the body portion 20. In other words, a proximal end of the second lower appendage 28 may be attached to the body portion 20 with a distal end being displaced from the body portion 20.

An upper tension member 44 may be situated within the interior space of the first upper appendage 22 and another upper tension member 44 may be situated within the interior space of the second upper appendage 24. More particularly, each upper tension member 44 may include a first end coupled to a respective side plate 42 of the internal frame member 34 and a second end coupled to a point proximate or adjacent the distal end a respective upper appendage.

A lower tension member 46 may be situated within the interior space of the first lower appendage 26 and another lower tension member 46 may be situated within the interior space of the second lower appendage 28. More particularly, each lower tension member 46 may include a first end coupled to a respective side plate 42 of the internal frame member 34 and a second end coupled to a point proximate or adjacent the distal end a respective lower appendage.

It is understood that each upper and lower tension member 44, 46 is resilient and length adjustable and movable between a linear configuration in line with an imaginary linear or longitudinal axis and a bended configuration not in line with the linear axis. In other words, each tension member is normally straight and has a fixed length but may be urged by manipulation and gentle force of a user into a curved or bent configuration. But, when said force or urging is discontinued, the tension member is resilient to return automatically to the unbent configuration.

Preferably, each upper and lower tension member 44, 46 is a tension spring that is normally in a retracted configuration but may be extended or made longer when it is pulled to a longer configuration, such as by a user. The tension spring may also be bent, generally rotated, and moved in forward, rearward, upward, or downward directions. But, when released, the tension spring is resilient to return to its normal retracted configuration. It is understood that the plurality of tension members disclosed herein need not be of a singular or consistent length or tension strength. For instance, one or more tension members may have one characteristic size and strength while one or more others may have a different characteristic size or strength. It is believed that variations in the specifications of the tension members will have greater beneficial impacts on users of the device 10. In an embodiment, respective body portions and appendages may include a color indicia or other indicia to indicate the degree or strength or tension of the internal tension members so that a user can select a desired exercise device for use.

In an embodiment, a top appendage 30 may be coupled to and extend away from an upper region of the body portion 20, the top appendage 30 defining an interior space. A top tension member 48 may be situated within the interior space of the top appendage 30 and include a construction and functional structures as described previously. In other words, the top tension member 48 may be a tension spring having the functional characteristics of respective upper tension members 44 and lower tension members 46.

Figure 1:
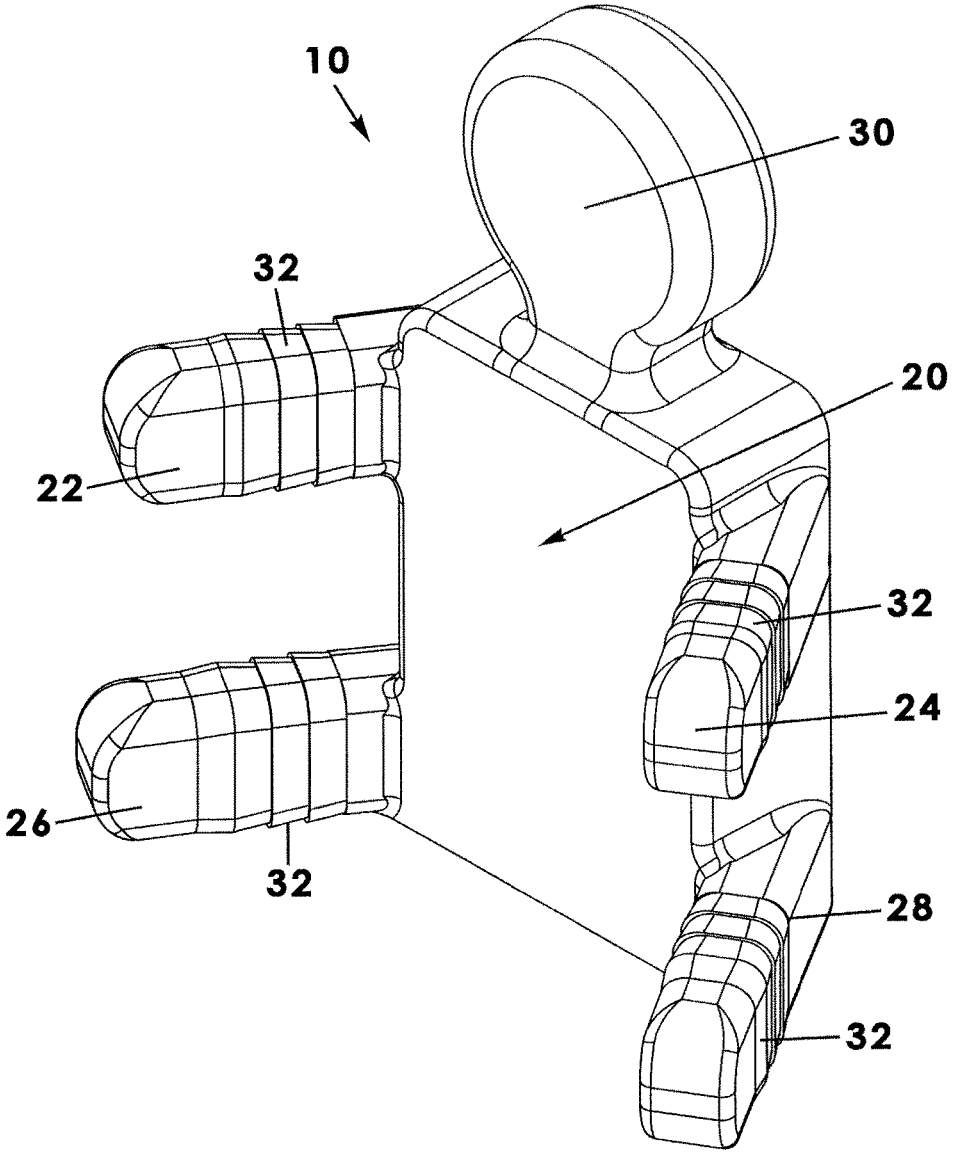
FIG. 1 is a perspective view of an exercise device according to a preferred embodiment of the present invention.
Figure 2:
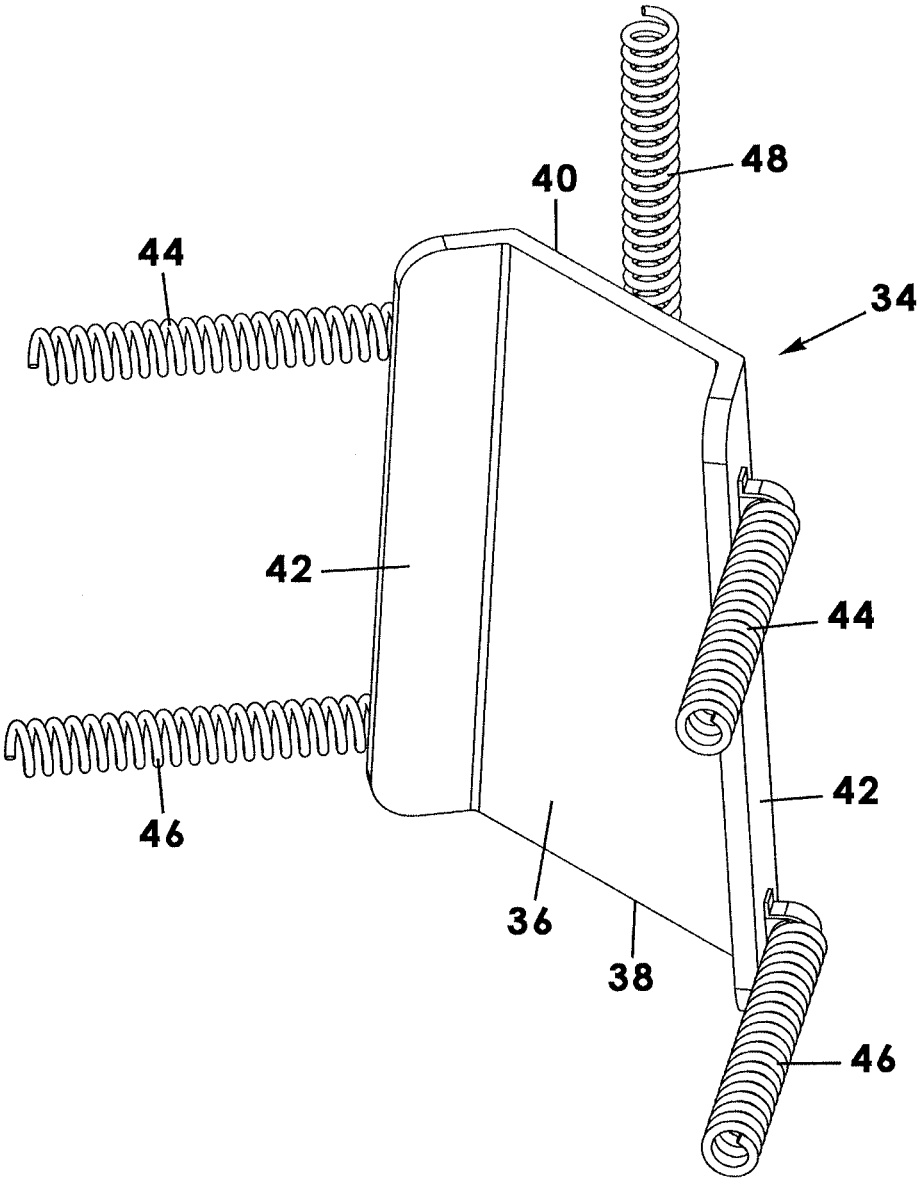
FIG. 2 is a perspective view of the exercise device as in FIG. 1 with the internal frame and tension members removed from the body portion.
Figure 3:
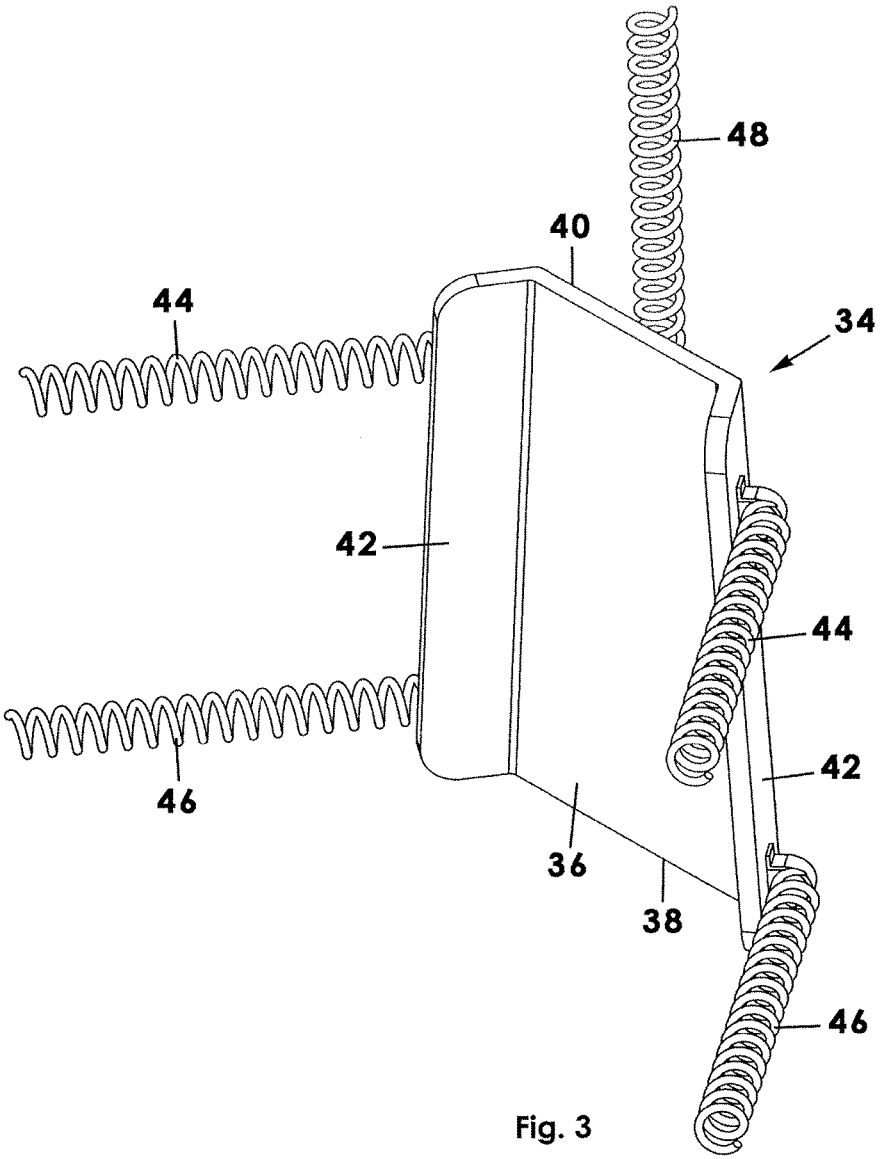
FIG. 3 is another perspective view of the exercise device as in FIG. 2 illustrated with the tension members at extended configurations.
Figure 4:
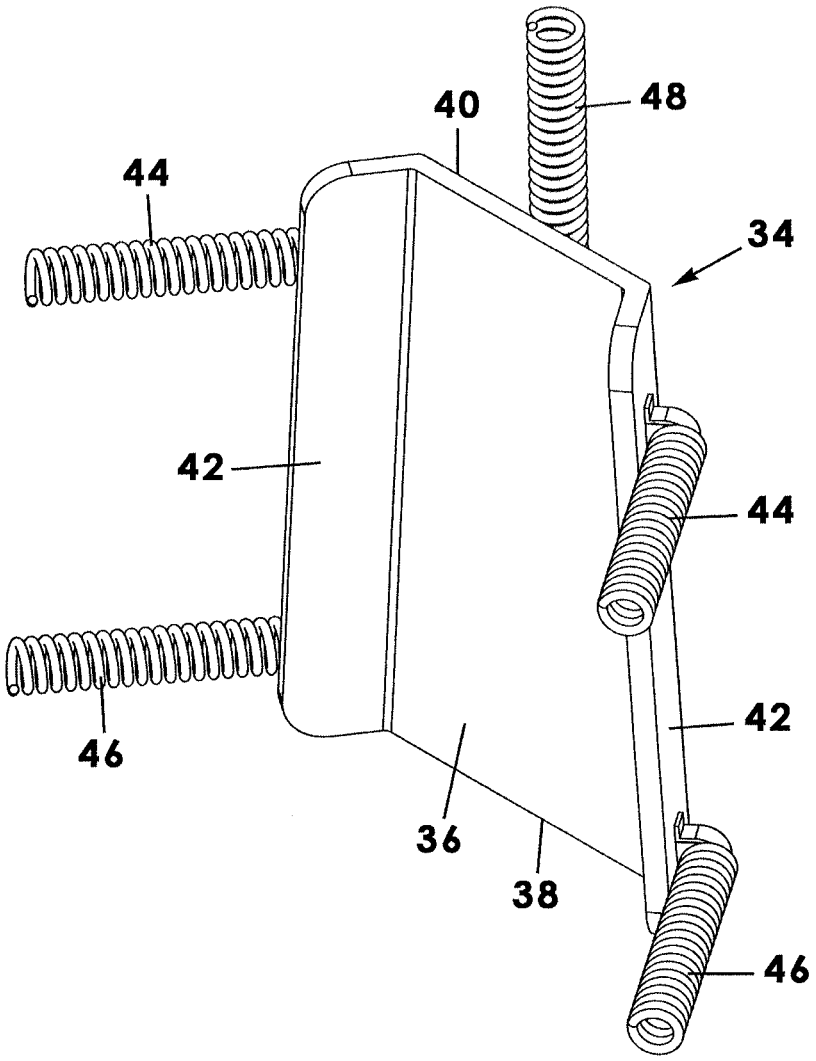
FIG. 4 is another perspective view of the exercise device as in FIG. 2 illustrated with the tension members at retracted configurations.
Figure 5A:
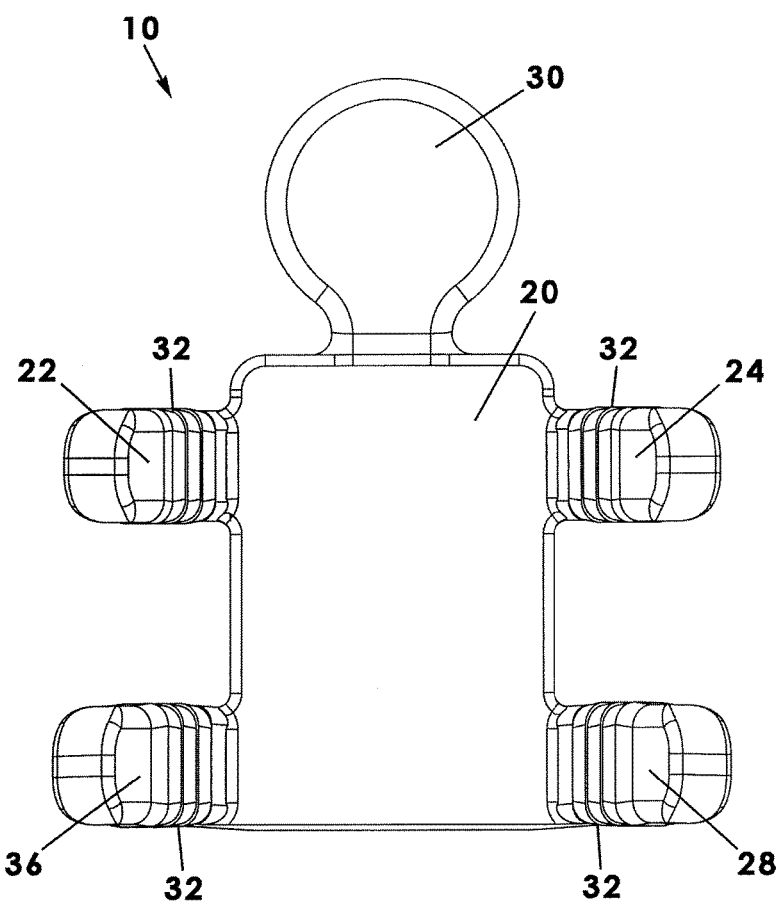
FIG. 5*a* is a front view of the exercise device as in FIG. 1.
Figure 5B:
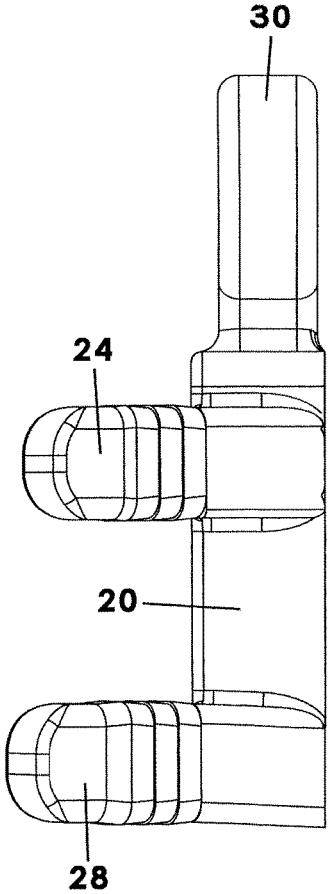
FIG. 5*b* is a side view of the exercise device as in FIG. 5*a;*
Figure 6A:
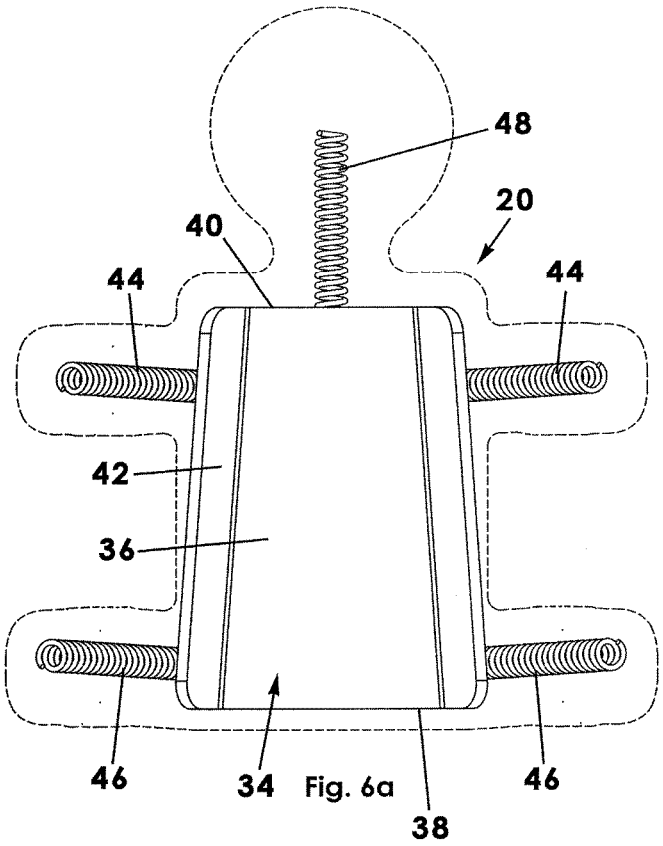
FIG. 6*a* is a front view of the internal frame member and tension members as in FIG. 4.
Figure 6B:
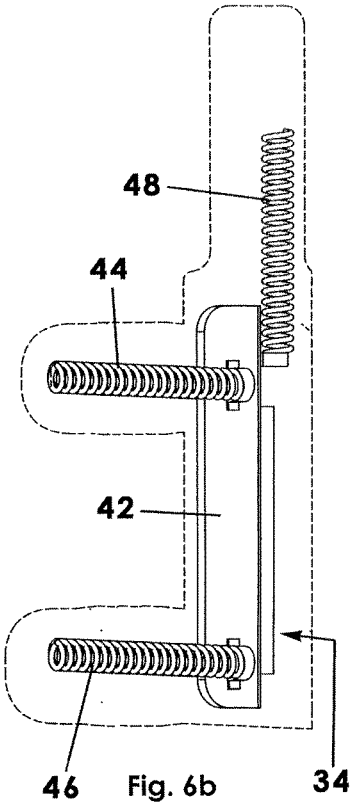
FIG. 6*b* is a side view of the internal frame member and tension members as in FIG. 6*a;*
Figure 6C:
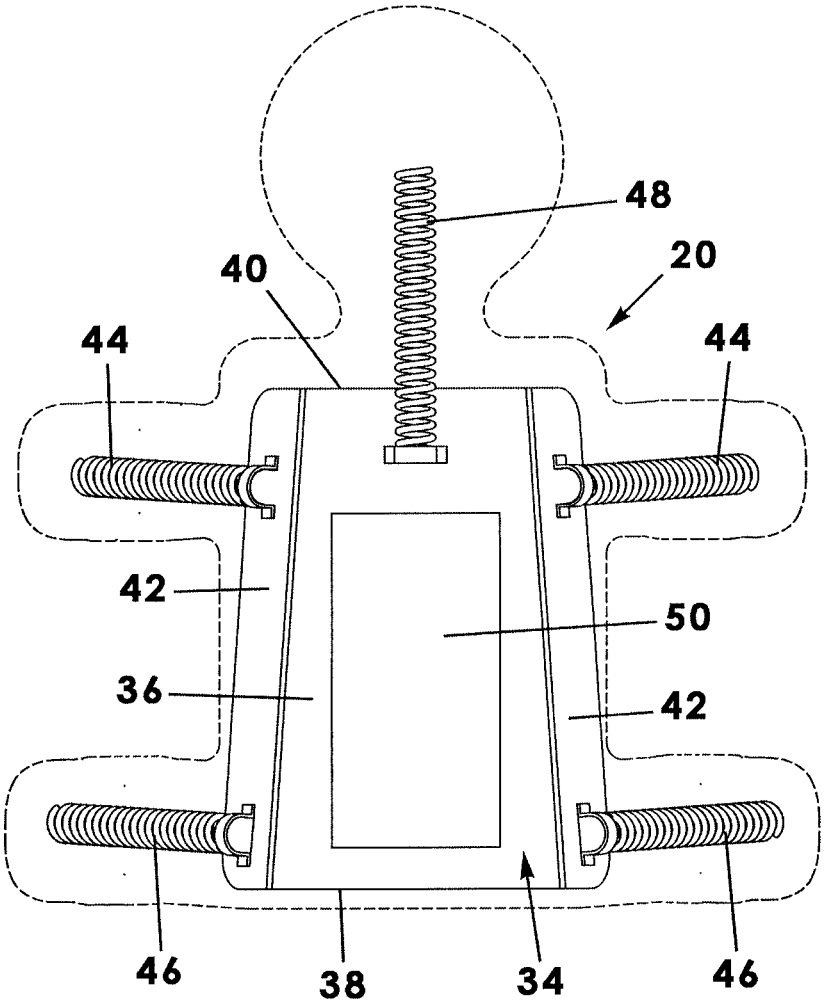
FIG. 6*c* is a rear internal frame member and tension members as in FIG. 6*a;*
Figure 7A:
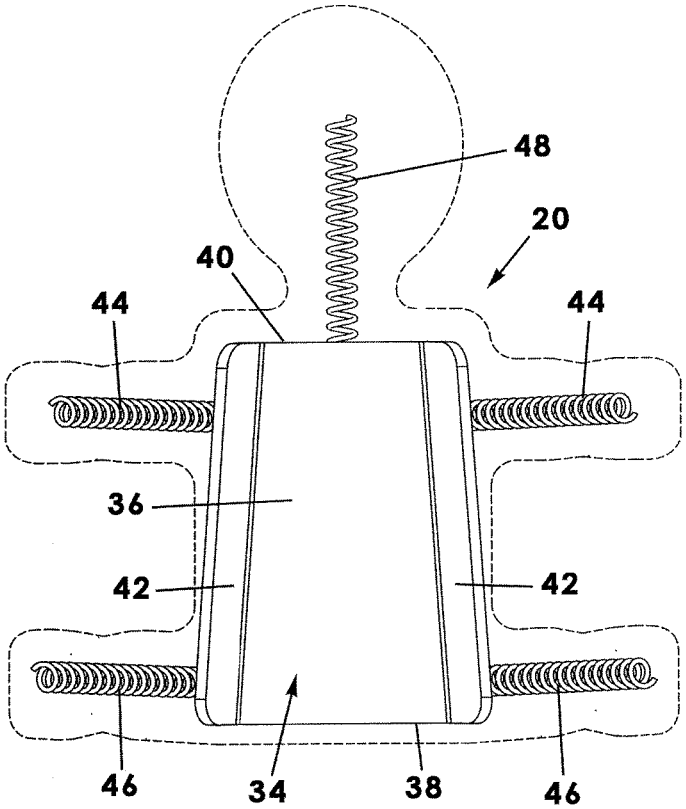
FIG. 7*a* is a front view of the internal frame member and tension members as in FIG. 4 with the tension members in a partially extended configuration.
Figure 7B:
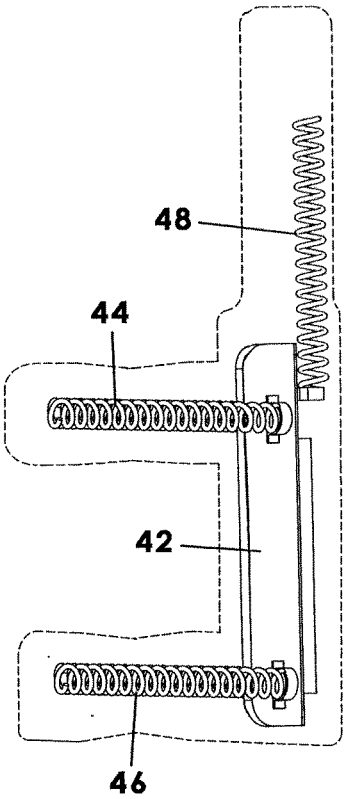
FIG. 7*b* is a side view of the internal frame member and tension members as in FIG. 7*a;*
Figure 8A:
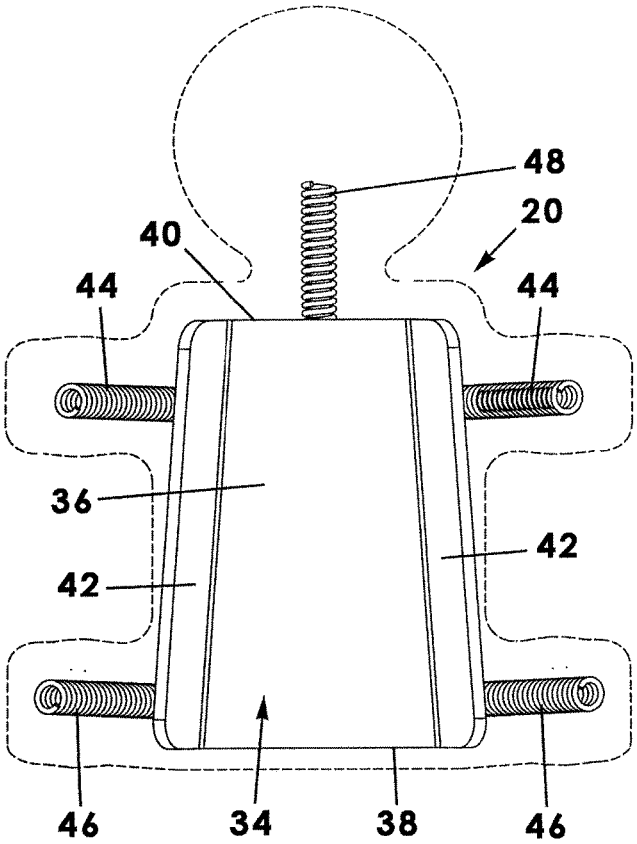
FIG. 8*a* is diagrammatic perspective view of the exercise device as in FIG. 2 illustrated with the tension members at retracted configurations.
Figure 8B:
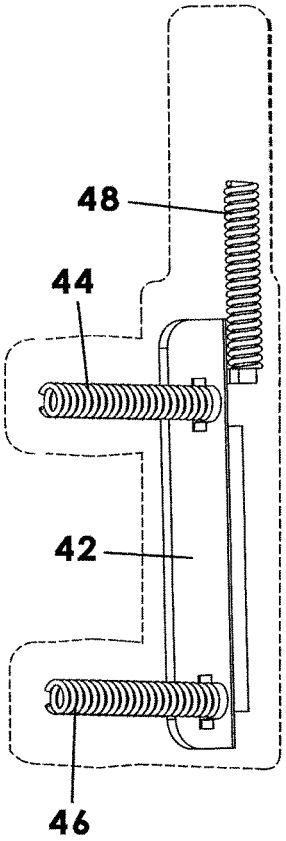
FIG. 8*b* is a side view of the device as in FIG. 8*a;*

Now with further reference to the movement and resilience of respective tension members, it will be understood that a user may grasp a respective appendage and, specifically, a distal end of a tension spring, and pull it outwardly, thus lengthening the spring. The body portion 20 extending about each of the upper appendages and lower appendages include a plurality of folded sections 32 (FIG. 1) that may be extended or pulled tight to accommodate a lengthening tension spring. In other words, when the tension springs are in their normal retracted or "at rest" configurations (FIG. 6*a*), the plurality of folded sections 32 has the appearance of a loose or "baggy" garment having plenty of slack (FIG. 1). Then, if a user applies gentle pulling pressure, the folded section 32 incrementally flattens or tightens to accommodate the lengthened spring. FIG. 3 illustrates tension members in extended or lengthened configurations and FIGS. 7*a* to 7*c* illustrate the tension members in extended configurations inside respective appendages. By contrast, FIG. 4 illustrates tension members in retracted configurations. FIGS. 6*a* to 6*c* illustrate the tension members in a retracted configuration inside respective appendages.

In another aspect of the invention, a magnet 50 may be coupled to a rear surface of the main plate 36 of the frame member 34 (FIG. 6*c*). Preferably, the magnet 50 is strong enough to attract and become magnetically bonded to other magnetic or metallic articles. For instance, the exercise device 10 may be magnetically coupled to a refrigerator door or other metal surface.

Accordingly, the exercise device 10 provides users having a need for light exercise to manually move, manipulate, and extend the various tension members as described above and, a result, receive needed exercise, stimulation, and enjoyment.

It is understood that while certain forms of this invention have been illustrated and described, it is not limited thereto except insofar as such limitations are included in the following claims and allowable functional equivalents thereof.

The invention claimed is:

1. An exercise device for use by persons with limited mobility or dexterity, comprising:

a body portion defining an interior area;

a frame member situated in said interior area;

a first upper appendage defining an interior space coupled to and extending away from an upper left region of said body portion;

a second upper appendage defining an interior space coupled to and extending away from an upper right region of said body member; and a pair of upper tension members respectively situated in the interior spaces of said first upper appendage and said second upper appendage, each upper tension member being resilient and length adjustable and configured for selective movement between bended and extended configurations when urged by a user and is resilient to automatically return to unbent and retracted configurations;

wherein said frame member includes:

a main plate having a planar configuration extending between said upper and lower ends, said main plate having a lower end that is wider than an upper end;

a pair of side plates coupled to respective side edges of said main plate, each side plate extending outwardly and forwardly relative to a front surface of said main plate;

a lower end of said pair of side plates, respectively, and a lower end of said main plate are configured, together, to support said frame member in an upright configuration upon a surface.

2. The exercise device as in claim 1, wherein:

each said upper tension member is a tension spring;

each tension spring defines a linear axis when at said normally retracted configuration and is flexible to bend away from said linear axis and is resilient to return to said linear axis.

3. The exercise device as in claim 1, wherein said upper tension members include first ends coupled to said pair of side plates, respectively, of said frame member and second ends coupled to a point adjacent a distal end of a respective said first upper appendages or said second upper appendage respectively.

4. The exercise device as in claim 1, further comprising:

a first lower appendage defining an interior space coupled to and extending away from an lower left region of said body member;

a second lower appendage defining an interior space coupled to and extending away from an lower right region of said body member;

a pair of lower tension members respectively situated in the interior spaces of said first lower appendage and said second lower appendage, each lower tension member being resilient and length adjustable and configured for selectively bending or extending when urged by a user and resiliently returning to an unbent or retracted configuration.

5. The exercise device as in claim 4, wherein each of said first and second lower appendages includes a loose fabric material having a plurality of folded sections selectively movable from a slack configuration when a respective said lower tension member is retracted and a tightened configuration when a respective said lower tension member is extended.

6. The exercise device as in claim 1, further comprising:

a top appendage defining an interior space coupled to and extending away from an upper region of said body member;

a top tension member situated in the interior space of said top appendage, said top tension member being resilient and length adjustable and configured for selectively bending or extending when urged by a user and resiliently returning to an unbent or retracted configuration.

7. The exercise device as in claim 6, wherein said first and second upper appendages, said first and second lower appendages, and said top appendage are arranged on said body portion to be indicative of arms, legs, and head of an animal.

8. The exercise device as in claim 1, wherein each of said first and second upper appendages includes a loose fabric material having a plurality of folded sections selectively movable from a slack configuration when a respective said upper tension member is at the retracted configuration and a tightened configuration when a respective said tension member is at the extended configuration.

9. The exercise device as in claim 1, further comprising a magnet coupled to said frame member having a magnetic attraction sufficient to attract and hold magnetic or metal objects proximate said body portion.

10. The exercise device as in claim 1, further comprising a magnet coupled to a rear surface of said main plate of said frame member, said magnet having a magnetic attraction sufficient to attract and hold magnetic or metal objects proximate said body member.

11. The exercise device as in claim 1, wherein said body portion is covered by a layer of a leather or faux-leather material that is durable.

12. The exercise device as in claim 1, wherein said pair of lower tension members and said pair of upper members do not have a uniform length.

13. The exercise device as in claim 1, wherein said pair of lower tension members and said pair of upper members do not have a uniform compression strength.

* * * * *